US005897205A

United States Patent [19]

Sinsteden

[11] Patent Number: 5,897,205

[45] Date of Patent: Apr. 27, 1999

[54] ATTACHMENT FOR POWER TOOLS FOR MIXING AEROSOL CANS

[76] Inventor: Michael Sinsteden, Bennettsbridge, Co. Kilkenny, Ireland

[21] Appl. No.: 08/979,420

[22] Filed: Nov. 26, 1997

[30] Foreign Application Priority Data

Dec. 2, 1996 [IE] Ireland ..... S733225

[51] Int. Cl.[6] ..... B01F 11/00

[52] U.S. Cl. ..... 366/212; 366/605

[58] Field of Search ..... 366/605, 208, 366/209, 212, 218, 240, 108, 110, 111, 113, 114, 115, 129, 130; 248/363; 279/3; 30/514, 500; 254/1; 4/255.11, 255.05

[56] References Cited

U.S. PATENT DOCUMENTS

| | | | |
|---|---|---|---|
| 998,718 | 7/1911 | Schultze | 279/3 |
| 1,430,050 | 9/1922 | Becker | 279/3 |
| 2,127,181 | 8/1938 | Mattern | 279/3 |
| 2,444,298 | 6/1948 | Kline | 279/3 |
| 2,634,998 | 4/1953 | Flower | 279/3 |
| 3,330,537 | 7/1967 | Watson | 366/114 |
| 4,398,829 | 8/1983 | Shick | 366/605 |
| 4,420,262 | 12/1983 | Sterrenberg | 366/111 |
| 5,098,193 | 3/1992 | Christensesn et al. | 366/130 |
| 5,439,287 | 8/1995 | Roepke, Sr. | 366/605 |

*Primary Examiner*—Tony G. Soohoo
*Attorney, Agent, or Firm*—Baker & Maxham

[57] ABSTRACT

The invention relates to a device for shaking aerosol spray paint cans. It comprises a flexible membrane (1) capable of forming a suction bond with an aerosol can (4), the membrane (1) being attachable to a power tool having a reciprocal motion output, for example a jig-saw.

17 Claims, 1 Drawing Sheet

ATTACHMENT FOR POWER TOOLS FOR MIXING AEROSOL CANS

FIELD OF THE INVENTION

The present invention relates to an attachment for power tools which may be used to shake aerosol spray paint cans to evenly mix the components e.g. paint. In particular the invention relates to an attachment for an aerosol can which has a concave base. The attachment is suitable for use with a jig-saw or other electrical power tool which has an oscillatory, vibratory or rotational motion.

The attachment is most suitable for use with a jig-saw having an adjustable speed control, as this allows for use with a variety of sizes and weights of aerosol cans.

BACKGROUND OF THE INVENTION

Many liquids e.g. paint which are supplied in aerosol cans must be shaken or stirred quite vigorously in order to create an even mixture of the components therein and to allow easy application of the paint, for lengthy periods i.e. 2 minutes. The key reason for poor workmanship with spray paints is insufficient mixing of the paint components.

It is known to provide paints and other liquids in aerosol cans which use a propellant gas to spray the liquid from the can. Again if the liquid contents have settled during storage before use, then it is necessary to shake the can quite vigorously in order to mix the contents of the can, and to allow easy and even application of the paint through the nozzle of the can. It is known to provide a ball-bearing or other such solid object within the body of the can in order to increase the mixing/stirring effect when the can is shaken.

U.S. Pat. No. 3,330,537 describes an attachment for a portable sander of the type having a vibrating shoe. The attachment comprises a pan-like structure having parallel end walls, parallel side walls, and a rectangular bottom with members secured to the underside of the bottom adapted to engage a cylindrical surface along spaced-apart longitudinal lines;

a lip at the upper edge of one part of the end walls adapted to slidably receive an end of the shoe, and a clamp attached to the opposite end wall adapted to engage the other end of the shoe when the shoe is at rest on the bottom of the adaptor member; and flexible means connected to the pan-like structure and adapted to removably hold a cylindrical container.

U.S. Pat. No. 4,318,622 describes an apparatus and method for utilizing a hand-held power drill having a rotatable chuck, for shaking paint containers and the like. The apparatus comprises a semi-cylindrical cradle for receiving a container of spray paint, securing means for removably securing the container of spray paint within the semi-cylindrical cradle, a bearing secured to the semi-cylindrical cradle and a first cylindrical drive shaft rotatably mounted within the bearing for moving about a first axis of rotation.

U.S. Pat. No. 4,398,829 discloses a can shaking kit for attachment to the rectangular sanding base of an inverted vibratory sander.

U.S. Pat. No. 5,050,996 describes a paint shaker apparatus powered by a pneumatic sanding tool.

U.S. Pat. No. 5,098,193 describes a spray can mixing apparatus comprising a wire coil body formed of a single wire made of a deformable memory retentent material, which defines a cylindrical central cavity. A lower end of the wire coil body extends and is co-axially aligned with the cylindrical opening cavity. A drill chuck is secured to the wire lower end portion to effect selective rotation of the wire coil body.

Many of the devices of the prior art involve rotation about, or vibratory motion in a direction perpendicular to, the longitudinal axis of the container.

OBJECT OF THE INVENTION

It is an object of the invention to provide a simple, cheap, yet effective alternative to the attachments described above. In particular it is an object of the invention, to provide an attachment which allows vigorous shaking of a container in a direction parallel to its longitudinal axis. This allows better and more efficient shaking of the container.

SUMMARY OF THE INVENTION

The invention relates to a device for shaking containers containing viscous liquids or liquid mixtures, the device comprising a substantially flat, substantially air impermeable flexible membrane, the flexible membrane being attachable to or forming part of, an attachment for a power tool, the power tool having a reciprocal or rotational or oscillatory motion output, and the flexible member being capable of forming a suction bond to the container, the suction bond being of sufficient strength to remain intact when the power tool is activated.

Suitably the flexible membrane is circular in shape, and is constructed of a plastics or rubber material. The flexible membrane is attachable to a container having a concave base.

In a more preferred embodiment the flexible membrane is provided with a teat or projection close to a peripheral edge thereof, the projection allowing for easy breaking of the suction bond between the membrane and the base of the can.

Suitably the power tool is a speed-controlled electrical jig-saw. The invention extends to a device substantially as described herein with reference to and as illustrated in the accompanying drawing.

DETAILED DESCRIPTION OF THE DRAWING

Figure 1:
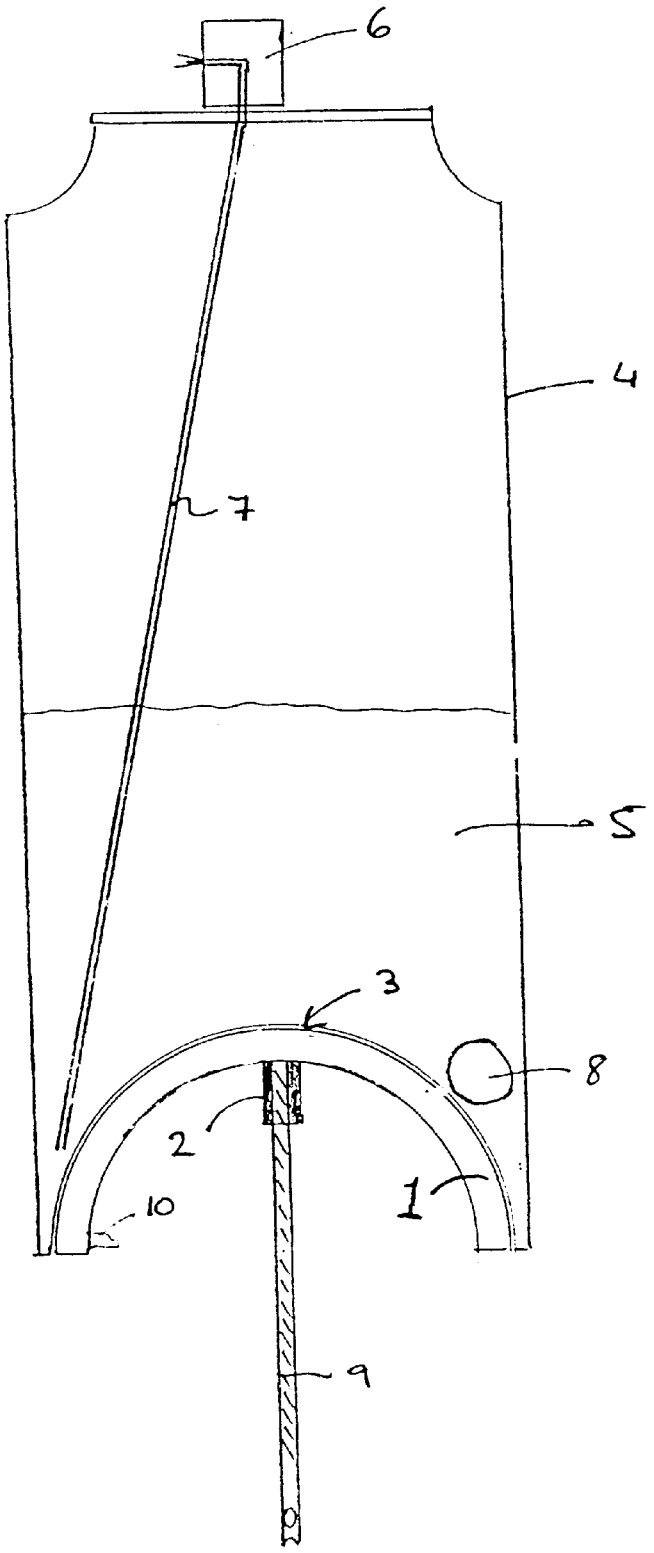
FIG. 1 is a side elevation of the device of the invention attached to an aerosol paint spray-can.

The device of the invention will now be described with reference to FIG. 1.

The device of the invention comprises a flexible substantially non-air permeable membrane 1 and a housing or mount 2. The membrane 1 is substantially circular in shape and in the embodiment shown has a diameter which allows the membrane 1 to conform exactly to the profile of the concave base 3 of a spray can 4. The spray can 4 is an aerosol spray can containing paint 5 and having a nozzle 6.

When nozzle 6 is depressed, the propellant gas in the can 4 forces paint 5 through outlet tube 7 and propels the paint from nozzle 6 thus allowing the paint to be sprayed on a surface.

A ball bearing 8 is provided in can 4 which, when can 4 is shaken, helps to stir and agitate the paint 5 thus reducing the amount of time and effort needed to evenly mix the paint in the can and thus provide paint with a consistency suitable for even spraying through nozzle 6.

If the can is not shaken vigorously enough or for long enough then the consistency of paint 5 may be uneven and result in a poor finish or even blockage of outlet tube 7 and/or nozzle 6.

Even with ball bearing 8 present in the can 4 it is still necessary to shake the can quite vigorously for a relatively long period of time in order to sufficiently mix the paint 5 particularly if done by hand. The flexible membrane 1 of the present invention is easily attached to base 3 of the can forming a suction cup arrangement. In particular as the base 3 of can 4 is concave this allows for extremely strong adhesion of flexible membrane 1 to the base 3 of the can.

Housing 2 which forms an integral part of the membrane 1 is used to attach the membrane 1 to an electrical power tool device in the embodiment shown. The housing 2 is permanently bonded to a shaft 9. The shaft 9 can be attached to a jig-saw instead of an ordinary blade.

A jig-saw has a reciprocal motion which moves the blade back and forth relative to the body of the jig-saw at a relatively high speed which gives the blade its normal cutting action. By attaching flexible membrane 1 to shaft 9 via housing 2 this reciprocal motion can be transferred to membrane 1. When flexible membrane 1 is attached to the bottom of can 4 using a suction arrangement then the reciprocal motion is further transferred to the can 4.

The bond of the flexible membrane 1 to the base of the can 3 allows severe shaking of small and large aerosol cans of paint or other substances in the vertical or inverted position. The vibratory motion of the jig-saw causes the steel ball 8 inside the spray can 4 to be propelled at a very high frequency through paint 5 as is evidenced by the sound of impact of ball bearing 8 both on the top and base of can 4. The high frequency motion of the ball bearing 8 together with the vibratory motion imparted to the liquid by the jig-saw is sufficient to ensure fast and efficient mixing of the paint. The process of mixing using the device of the present invention requires approximately 30 seconds as distinct from up to 2 minutes which is the usual recommendation of paint manufacturers.

In order to allow easy removal of the flexible membrane 1 from the base 3 a teat or projection 10 may be provided at one edge thereof. The projection 10 may be formed as an integral part of the membrane. Pulling the projection 10 allows air between the flexible membrane 1 and the base 3 thus breaking the strong suction bond and allows for easy removal of the flexible membrane 1.

The membrane 1 should be of a diameter which is less than the diameter of the base of the can to be shaken. A single size 50 mm diameter cup is suitable for all currently commercially available spray cans. However, it is clearly within the scope of this invention to provide membranes of different sizes required for different sized cans.

I claim:

1. A device for shaking aerosol cans containing viscous liquids or liquid mixtures, the device comprising a substantially flat, substantially air impermeable flexible membrane, the membrane having means for attachment to a power tool, the power tool having at least a reciprocal motion output and the flexible membrane being capable of forming a suction bond with the aerosol can, the suction bond being of sufficient strength to remain intact when the power tool is activated.

2. A device according to claim 1 wherein the flexible membrane is circular in shape.

3. A device according to claim 2 to wherein the membrane is constructed of a plastics or rubber material.

4. A device according to claim 2 wherein the flexible membrane is provided with a projection close to a peripheral edge thereof, the projection enabling easy breaking of the suction bond between the membrane and the base of the can.

5. A device according to claim 4 to wherein the membrane is constructed of a plastics or rubber material.

6. A device according to claim 2 wherein the flexible membrane is provided with a teat or projection close to a peripheral edge thereof, the projection allowing for easy breaking of the suction bond between the membrane and the base of can.

7. A device according to any of claims 6 wherein the membrane is constructed of a plastics or rubber material.

8. A device according to claim 1 wherein the flexible membrane is provided with a projection close to a peripheral edge thereof, the projection enabling easy breaking of the suction bond between the membrane and the base of the can.

9. A device according to claim 8 to wherein the membrane is constructed of a plastics or rubber material.

10. A device according to claim 1 to wherein the membrane is constructed of a plastics or rubber material.

11. A device according to claim 1 to wherein the means for attachment to a power tool comprises a shaft attached at one end to the membrane and having means at another end for connecting to a blade driver of a jig-saw.

12. A device according to claim 11 to wherein the shaft is attached to the center of the membrane.

13. A device according to claim 12 to wherein the shaft is attached to the center of the membrane by means of a socket formed by the membrane for receiving the end of the shaft.

14. An apparatus for shaking aerosol cans containing viscous liquids, comprising:

a substantially flat, substantially air impermeable flexible membrane of a size and shape for fitting a bottom of an aerosol can and being capable of forming a suction bond with the aerosol can; and a shaft attached at one end to the membrane and, having means at another end for connecting to a blade driver of a jig-saw.

15. A device according to claim 14 wherein the flexible membrane is circular in shape.

16. A device according to claim 15 wherein the flexible membrane is provided with a teat or projection close to a peripheral edge thereof, the projection allowing for easy breaking of the suction bond between the membrane and the base of can.

17. A device according to claim 14 wherein the membrane is constructed of a rubber material.

* * * * *